United States Patent [19]

Fujitani et al.

[11] Patent Number: 4,674,819

[45] Date of Patent: Jun. 23, 1987

[54] ELECTRIC WIRE BRANCHING CONNECTOR DEVICE

[75] Inventors: Mitsuhiro Fujitani; Yoshihiro Tanaka, both of Yokkaichi, Japan

[73] Assignee: Sumitomo Wiring Systems, Ltd., Yokkaichi, Japan

[21] Appl. No.: 763,249

[22] Filed: Aug. 7, 1985

[30] Foreign Application Priority Data

Aug. 7, 1984 [JP] Japan ..... 59-165474
Aug. 7, 1984 [JP] Japan ..... 59-121156[U]
Aug. 7, 1984 [JP] Japan ..... 121157[U]

[51] Int. Cl.[4] ..... H01R 4/24; H01R 9/07

[52] U.S. Cl. ..... 339/99 R; 339/176 MF; 339/176 M

[58] Field of Search ..... 339/97 R, 97 P, 98, 339/99 R, 17 F, 176 MF, 176 M

[56] References Cited

U.S. PATENT DOCUMENTS 3,150,910 9/1964 Dodd ..... 339/256 SP
3,636,500 1/1972 Sedlacek ..... 339/97 R
4,350,405 9/1982 Yapoudjian et al. ..... 339/97 P
4,429,943 2/1984 Inoue ..... 339/198 R
4,484,791 11/1984 Johnson ..... 339/99 R
4,564,254 1/1986 Van Alst ..... 339/99 R

FOREIGN PATENT DOCUMENTS 2535533 5/1984 France ..... 339/97 P
0009886 1/1977 Japan ..... 339/97 R
1076628 7/1967 United Kingdom ..... 339/99 R

*Primary Examiner*—Eugene F. Desmond
*Assistant Examiner*—Gary F. Paumen
*Attorney, Agent, or Firm*—Cushman, Darby & Cushman

[57] ABSTRACT

An electric wire branching connector device is used for forming branching circuits in a wire harness system. The device has an upper case and a lower case adapted to clamp therebetween a first group of electric wires extracted from the wire harness system and arranged in a side-by-side fashion. The device also has a plurality of terminal strips inserted into corresponding holes formed in the upper case. Each of the terminal strips is provided at its one end with at least one male terminal adapted to be received in a hole or holes and at its other end with a wire grip portion having a U-shaped slot. The male terminals of the terminal strips are projected through the holes above the upper surface of the upper case such as to form plug for receptacle connectors to which are connected electric wires 4B of a second group also extracted from the wire harness system. The wire grip portions are projected below the underside of the upper case such that the electric wires of the first group are forcibly received in the U-shaped slots. In consequence, the electric wires of the first group and the electric wires of the second group are electrically connected to each other through the terminal strips, thereby forming the desired branching circuits.

4 Claims, 13 Drawing Figures

ELECTRIC WIRE BRANCHING CONNECTOR DEVICE

BACKGROUND OF THE INVENTION

1. Field of the Invention

The present invention relates to an electric wire branching connector device which is provided at an intermediate portion of a wire harness system and adapted for mutually connecting some of the electric wires in the harness such as to concentrically form branching circuits.

2. Description of the Prior Art

A typical conventional arrangement for forming branching circuits by mutually connecting electric wires in a wire harness system has a junction box accommodating BUS bars which are beforehand arranged such as to form required branches. The electric wires to be used in the branching circuits are extracted from the wire bundle of the harness and are connected at their end connectors to the corresponding sockets or receptacles of the junction box such as to form the desired branching circuits through the BUS bars.

According to this arrangement, the design of the circuits is fixed and, hence, cannot be adapted to a variety of circuit arrangements because the required branching circuits are constituted by rigid BUS bars. Thus, the design of the junction box including the arrangement of the BUS bars becomes necessary each time a circuit arrangement is to be made, requiring much cost and time.

In addition, since the branching circuits are formed by BUS bars arranged in layers through the intermediary of insulating plates, the size of the connector device as a whole, as well as the number of parts thereof, is inevitably increased. This runs quite contrary to the current demand for small-sized and compact wire harnesses.

SUMMARY OF THE INVENTION

Accordingly, an object of the invention is to provide an improved electric wire branching connector device which is capable of overcoming the above-described problems of the prior art.

To this end, according to the invention, there is provided an electric wire branching connector device for concentrically forming branching circuits in a wire harness system, comprising: an upper case and a lower case adapted to clamp therebetween a first group of electric wires extracted from the wire harness system and arranged in a side-by-side fashion; and a plurality of terminal strips inserted to corresponding holes formed in the upper case, each of the terminal strips being provided at its one end with at least one male terminal adapted to be received in the hole or holes and at its other end with a wire grip portion having a U-shaped slot, the male terminals of the terminal strips being projected through the holes above the upper surface of the upper case such as to form receptacles for connectors to which are connected electric wires 4B of a second group also extracted from the wire harness system, while the wire grip portions are projected below the underside of the upper case such that the electric wires of the first group are forcibly received in the U-shaped slots, whereby the electric wires of the first group and the electric wires of the second groups are electrically connected to each other through the terminal strips, thereby concentrically forming the desired branching circuits.

In the electric wire branching connector of the invention described above, electric wires to be connected are arranged in a side-by-side fashion between the upper case and the lower case and are connected through terminal strips which are fitted in the upper case, thereby forming the branching circuit. With this arrangement, the electric wire branching connector device is reduced in size and simplified in construction. In addition, the degree of freedom of design of the branching circuit is increased because of free selection and arrangement of the terminal strips. This in turn increases the adaptability of the connector device enabling a variety of changes to be made in the design of the branching circuits.

The above and other objects, features and advantages of the invention will become clear from the following description of the preferred embodiments when the same is read in conjunction with the accompanying drawings.

DESCRIPTION OF THE PREFERRED EMBODIMENTS

Preferred embodiments of the invention will be described hereinunder with reference to the accompanying drawings.

Figure 1:
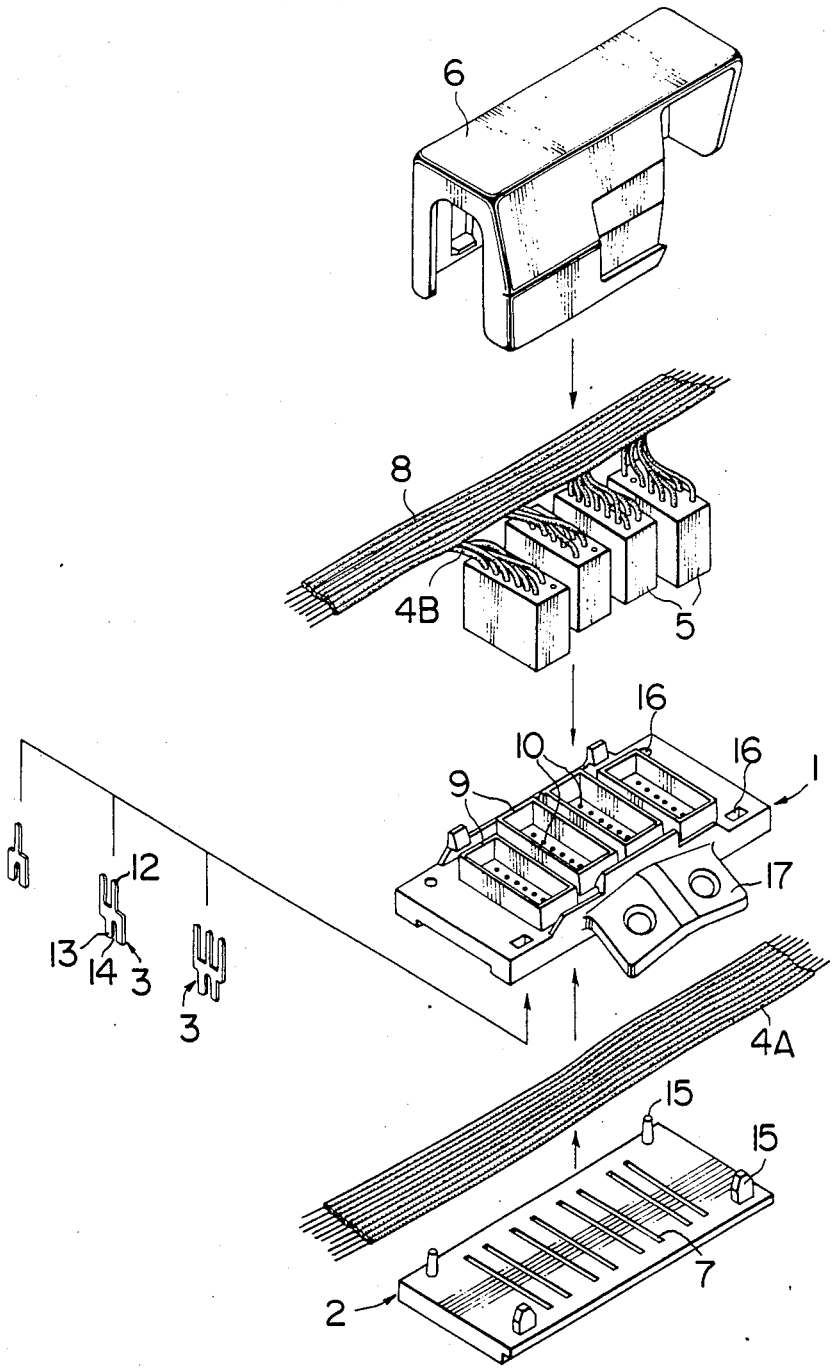
FIG. 1 is a perspective view of the whole portion of a first embodiment of the branching connector device in accordance with the invention.

Referring to FIGS. 1 to 5 showing a first embodiment, particularly to FIG. 1 showing the whole portion of an electric wire branching connector device of the invention and FIG. 3 showing terminal strips incorporated in the embodiment shown in FIG. 1, an electric wire branching connector device of the invention has an upper case 1 and a lower case 2 which are adapted to cooperate with each other in clamping therebetween a group of electric wires 4A extracted from the wire harness 8. A plurality of terminal strips 3, each having at its one end one or more male terminals 12 and at its other end a wire grip portion 13, are inserted into the upper case 1. The male terminals 12 are projected above the upper surface of the upper case 1 such as to form connector receptacles 9 which are designed to receive connectors 5 of another group of electric wires 4B extracted from the wire harness 8. The wire grip portions 13 of the terminal strips 3 are projected from the underside of the upper case 1 such as to be pressed onto the first group of electric wires 4A clamped between the upper and lower cases 1 and 2, so that the first group of electric wires 4A and the second group of electric wires 4B are connected to each other such as to form the desired branching circuits concentrically.

Figure 2:
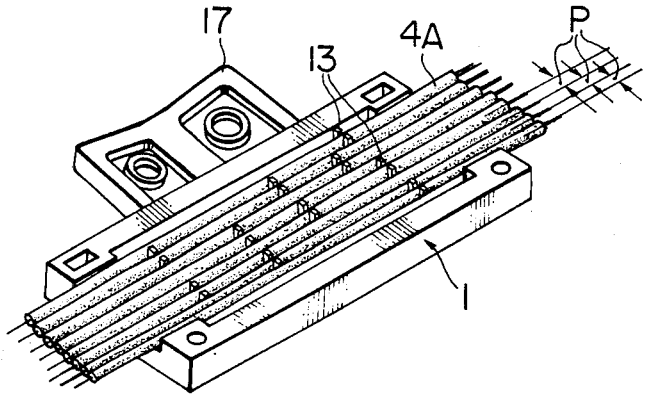
FIG. 2 is a perspective view of the rear side of an upper case incorporated in the embodiment shown in FIG. 1.
Figure 4:
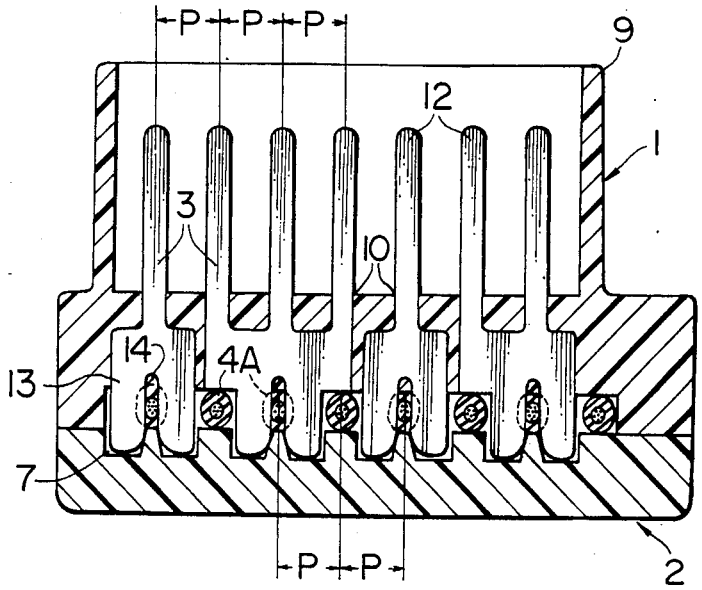
FIG. 4 is a cross-sectional view of the embodiment shown in FIG. 1, illustrating the manner in which electric wires are clamped.

The upper and lower cases 1 and 2 have generally plate forms such as to be superposed on each other. The upper case 1 is provided on the upper side thereof with a plurality of rectangular frames which constitute the walls of the connector receptacles 9. Each rectangular frame is provided in the bottom thereof with a multiplicity of holes 10 which are adapted to receive the male terminals 12 of the terminal strips 3. The holes 10 are arranged at a constant pitch P transversely of the upper case 1 so that, when the first group of electric wires 4A clamped between the upper and lower cases 1 and 2 are arranged at the same pitch P, the holes 10 are positioned right above the electric wires 4A of the first group, as shown in FIGS. 2 and 4. As the male terminals 12 of the terminal strips 3 are inserted into the holes 10 from the rear side, the male terminals 12 project above the upper surface of the upper case 1 thus completing the connector receptacles 9, while the wire grip portions 13 project downward from the underside of the upper case such as to receive corresponding electric wires 4A of the first group in their U-shaped slots 14.

As will be seen from FIG. 3, each terminal strip 3 is a web-like member which is provided at its one end with one (single electrode) or more (plural electrodes) male terminals 12 and at its other end with the wire grip portion 13 having the U-shaped slot 14. The U-shaped slot 14 is so designed that, when the wire grip portion 13 is pressed onto corresponding electric wire 4A of the first group, the electric wire is forcibly received in the U-shaped slot 14 with the sheath of the electric wire 4A cut by the edges defining the U-shaped slot 14, so that the electric wire 4A is electrically connected to the wire grip portion 13, i.e., to the terminal strip 3.

Figure 3A:
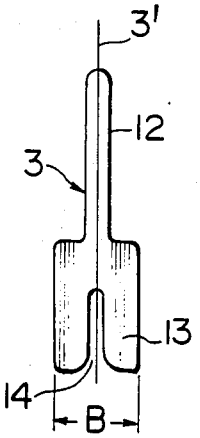
FIGS. 3A, 3B and 3C are front elevational views of terminal strips incorporated in the embodiment shown in FIG. 1.
Figure 3B:
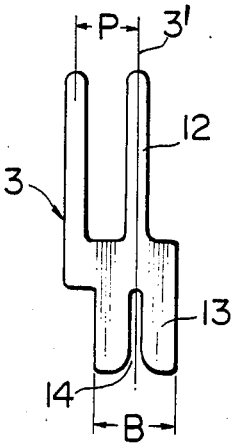
Figure 3C:
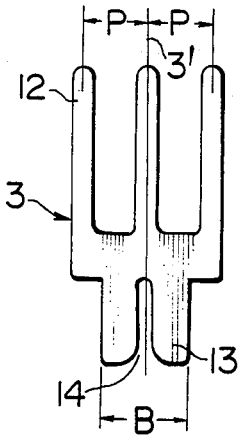

When the terminal strip 3 has only one male terminal 12, the longitudinal axis of the male terminal 12 aligns with that 3' of the slot 14, as will be seen from FIG. 3A. When the terminal strip has two or more male terminals, one or more male terminals are positioned at either one or both sides of the common longitudinal axis 3' at a distance P which is equal to the pitch of the holes 10, as shown in FIGS. 3B and 3C.

The wire grip portion 13, which is often required to grip electric wires of large diameters on the order of 0.5 sq cutting the sheath thereon, has a comparatively large thickness of 0.8 to 1.0 mm such as to exhibit a rigidity large enough to avoid any buckling or bending during gripping operation. The breadth B of the wire grip portion 13 is constant regardless of the number of male terminals 12. As will be seen from FIG. 4, the wire grip portions 13 are arranged for every other one of the electric wires 4A of the first group while the alternate electric wires 4A of the first group are disposed between wire grip portions 13 of adjacent terminal strips 3, when viewed in cross-section perpendicular to the longitudinal axis of the upper case 1. The extreme ends of the fingers of the wire grip portions 13 and the edges defining the entrance of the U-shaped slot 14 are suitably rounded such as to provide a guide for receiving the electric wire 4A. Grooves 7 for receiving the lower ends of the wire grip portions 13 of the terminal strips 3 projecting downwardly from the underside of the upper case 1 are formed in the upper surface of the lower case 2 such as to extend transversely of the lower case 2. The upper and lower cases 1 and 2 can be assembled together in the right position by virture of mutual engagement between posts 15 formed on the corners of the lower case 2 and corresponding holes 16 formed in the corners of the upper case 1.

In the assembly of the first embodiment of the electric wire branching connector device, a plurality of terminal strips 3, which are selected and arranged in a predetermined order in accordance with the patterns of the branching circuits to be formed, e.g., a single-electrode terminal strip, three-electrode terminal strip, single-electrode terminal strip and a two-electrode terminal strip as shown in FIG. 4, are inserted into corresponding holes 10 along a line transverse to the upper case 1 from the underside of the latter. On the other hand, electric wires 4A of the first group are arranged at the pitch P, and are forced into the U-shaped slots 14 of the wire grip portions at once by means of, for example, a pressing device, whereby the electric wires 4A are electrically connected to the terminal strips 3.

Subsequently, the lower case 2 is attached to the lower side of the upper case 1 and the pillars 15 are welded to the walls of the corresponding holes 16 by, for example, supersonic wave. In consequence, the upper case 1 and the lower case 2 are integrated with each other with the electric wires 4A interposed therebetween.

Then, the connectors 5 to which the electric wires 4B of the second group are connected are fitted in the connector receptacles 9 such that female terminals in the connector 5 mate with the male terminals 12 of the terminal strips 3 so that the electric wires 4A and 4B of the first and second groups are electrically connected through the terminal strips 3, thereby forming the required branching circuits in the wire harness 8.

Figure 5:
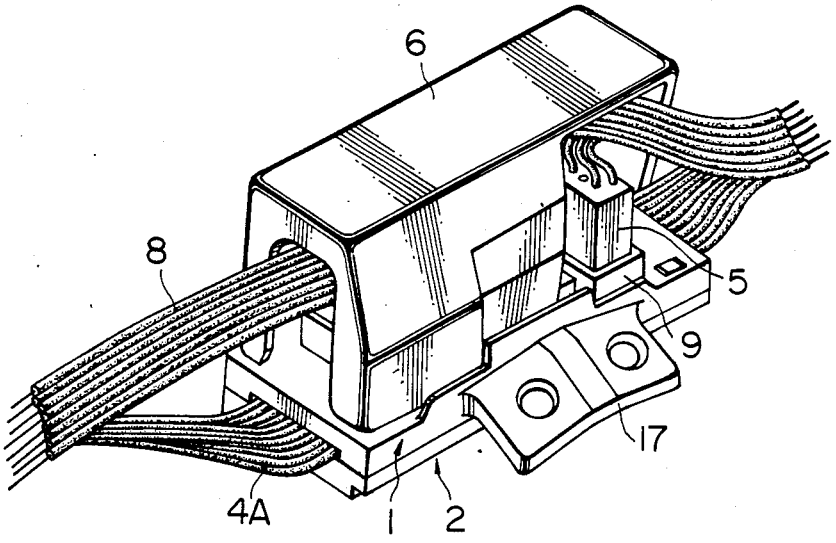
FIG. 5 is a perspective view showing the manner in which the branching connector device shown in FIG. 1 is connected to a wire harness.

Finally, a cover 6 is put on the connector device such as to cover the connector device and the wire bundle constituting the wire harness 8, as shown in FIG. 5. Thus, the branching connector device is held on an intermediate portion of the wire harness 8 and is mounted on a vehicle body by means of a mounting bracket 17 formed as a unit with the upper case 1, whereby the wire harness 8 incorporating the branching circuits is fixed to the vehicle body.

As will be understood from the foregoing description, in the first embodiment of the electric wire branching connector device of the invention, the first group of electric wires 4A to be connected are clamped between the upper and lower cases 1 and 2 and are connected to the electric wires 4B of the second group through the terminal strips 3, thus concentrically forming the branching circuits. With this arrangement, it is possible to obtain branching circuits with a much smaller and compact construction than the conventional arrangement which makes use of BUS-bar type connector device. At the same time, the number of parts is reduced and the consumption of metal is reduced by virture of elimination of BUS bars, thus reducing the production cost of the connector device remarkably.

It is to be noted also that the electric wire branching connector device of the invention can form the desired branching circuits in such a concentrated manner that the device is embraced or held on the wire harness 8 without substantially increasing the outside dimension of the wiring system constituted by the wire harness Thus, the construction of the wire system as a whole is made quite compact as compared with the conventional arrangement in which the electric wires are extended from the wire harness 8 to a separate junction box which is spaced apart from the wire harness. Thus, the electric wire branching connector device of the invention well meets the current demands for a miniaturized and compact wiring system.

The described embodiment of the electric wire branching connector device of the invention is also advantageous in that it permits a greater degree of freedom in the design of the branching circuits, as well as a large adaptability to a variety of design changes. Namely, it is quite easy to obtain branching circuit arrangements for a variety of designs using the same combination of upper and lower cases, by free selection of the several types of terminal strips 3, as well as the order of arrangement of the same, by virture of the fact that the electric wires 4A of the first group are arranged side-by-side at a constant pitch P which is equal to the pitch P of the male terminals 12 on the terminal strips 3 regardless of the number of male terminals on each terminal strip.

FIGS. 6 to 11 show a second embodiment of the invention. This embodiment of the electric wire branching connector device also has a combination of an upper case 101 and a lower case 102. In this embodiment, however, the upper and lower cases 101 and 102 are provided with grooves 107A and 107B which receive the electric wires 4A of the first group extracted from the wire harness 8. A plurality of terminal strips 3 are inserted into the upper case 101. The terminal strip 3 is provided at its one end with one or more male terminals 12 and at its other end with a wire grip portion 13 having U-shaped slot 14 and, hence, is of the same type as that used in the first embodiment. The male terminals 12 are projected above the upper surface of the upper case 101 such as to form connector receptacles 109 which are adapted to receive connectors 5 to which are connected electric wires 4B of the second group also extracted from the wire harness 8. The electric wires 4A of the first group are adapted to be forcibly driven into the U-shaped slots 14 in the wire grip portions of respective terminal strips 3 projecting downwardly from the underside of the upper case 1 so that the electric wires 4A and 4b of the two groups are electrically connected to each other through the terminal strips 3 thus forming the desired branching circuits concentrically.

More specifically, the upper and lower cases 101 and 102 have tabular forms such that the upper case 101 is superposed to the lower case 102. Rectangular frames constituting the connector receptacles 109 are formed on the upper surface of the upper case 1. A plurality of holes 110 is provided for receiving the male terminals 12 of the terminal strips 3. The upper case 101 is also provided at the underside thereof with a plurality of wire-receiving grooves 107A adapted for receiving upper half parts of the electric wires 4A arranged longitudinally of the upper case 101, such that the grooves 107A are aligned with the U-shaped slots 14 of the terminal strips 3 inserted into the holes 110.

Figure 7:
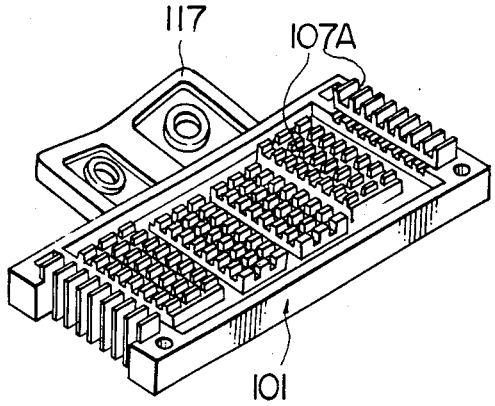
FIG. 7 is a perspective view of the rear side of an upper case incorporated in the second embodiment.
Figure 8:
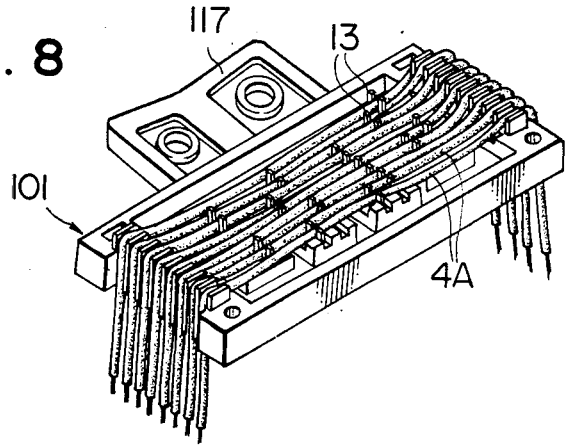
FIG. 8 is a perspective view showing the manner of use of the upper case in the second embodiment.

As will be clearly seen from FIGS. 7 and 8, the wire receiving grooves 107A extend longitudinally of the upper case 101 and are arranged transversely of the upper case 101 in a side-by-side fashion.

On the other hand, the lower case 102 is provided in the upper surface thereof with a plurality of wire-receiving grooves 107B corresponding to the grooves 107A in the upper case 101, such as to receive the lower half parts of the electric wires 4A. The wire-receiving grooves 107B extend longitudinally of the lower case 102 and are arranged transversely of the same in a side-by-side fashion.

The electric wires 4A of the first group are clamped between the upper and lower cases 101 and 102 and received in corresponding wire-receiving grooves 107A and 107B in respective cases. When the electric wire branching connector device is assembled, the electric wires 4A are forcibly driven into the U-shaped slots 14 of corresponding terminal strips 3 so that the sheath of wires is cut by the edges defining the U-shaped slots, such as to be electrically connected to the terminal strips 3. The lower case 102 is also provided in the upper surface thereof with transverse grooves 119 adapted for receiving the lower ends of the terminal strips projecting from the underside of the upper case 101. In this assembly, the upper and lower cases 101 and 102 are held in the right positions by virture of mutual engagement between the pillars 115 formed on the corners of the lower case 102 and holes 116 formed in the corners of the upper case 101.

Figure 6:
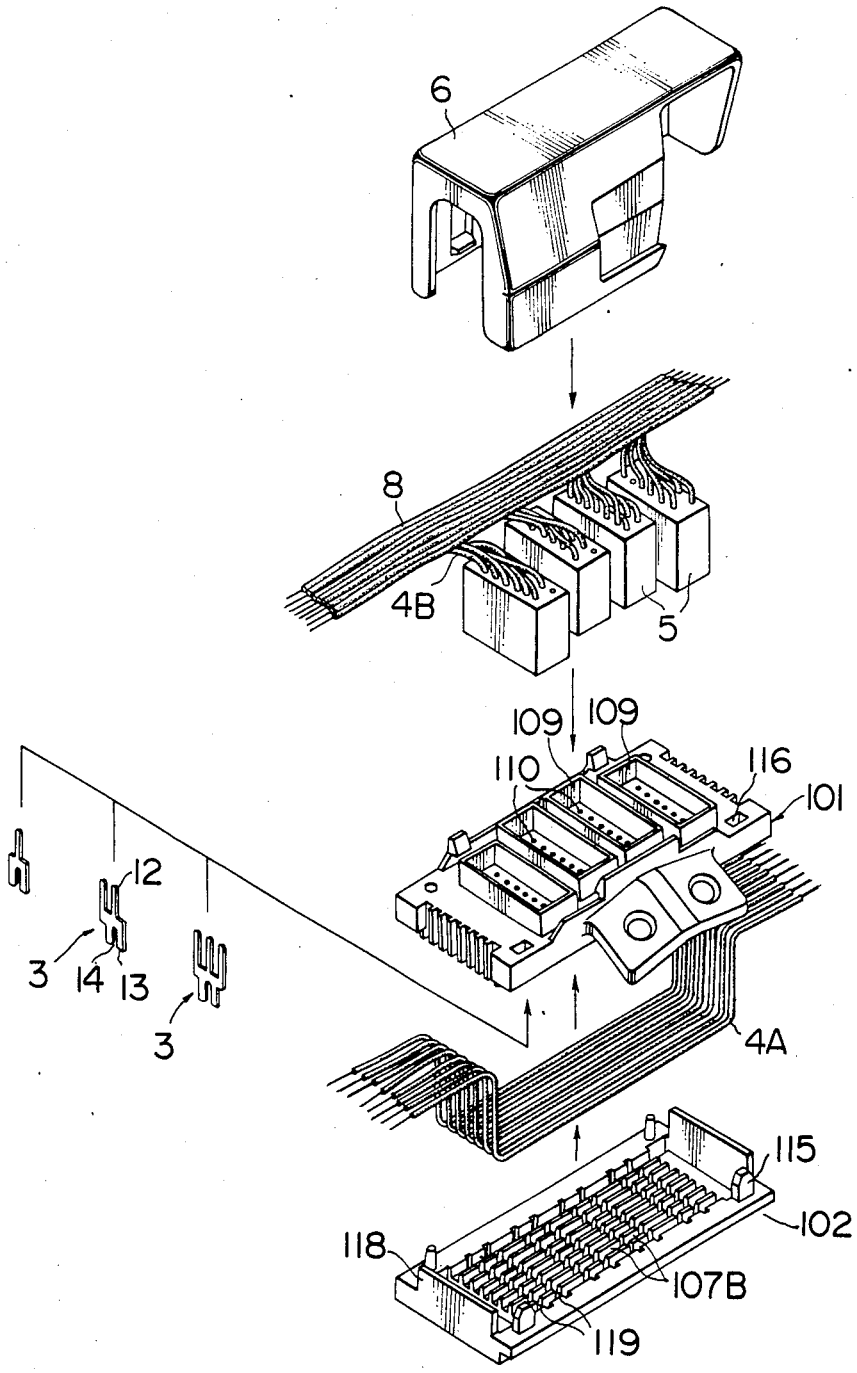
FIG. 6 is a perspective view of a second embodiment of the electric wire branching connector device of the invention.

As will be seen from FIG. 6, the lower case 102 is further provided with guide walls 118 formed on both longitudinal ends thereof and adapted to bend the electric wires 4A at both longitudinal ends of the connector device such that the wires 4A on both longitudinal ends of the connector device are laid in and along extensions of the wire-receiving grooves 107A on both longitudinal end surfaces of the upper case 101.

Figure 9:
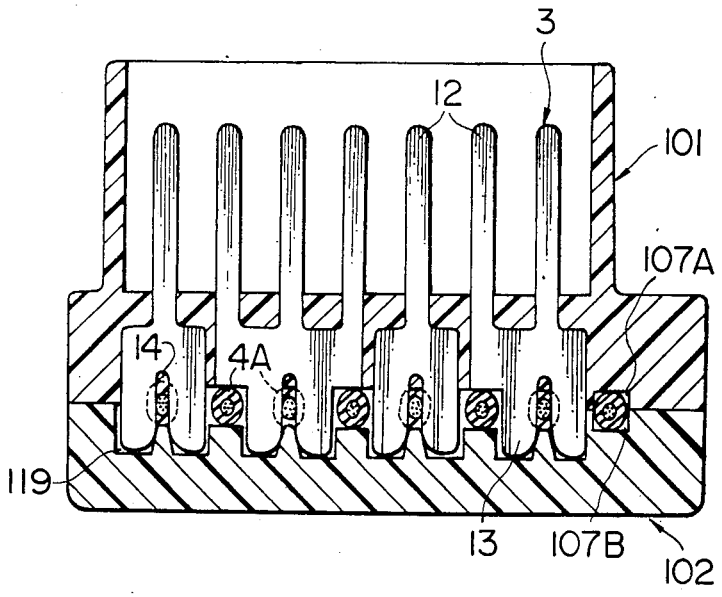
FIGS. 9 and 10 are cross-sectional views of the second embodiment illustrating the manner in which the electric wires are accommodated by the second embodiment.

In the assembly of the second embodiment of the electric wire branching connector device, a plurality of terminal strips 3, which are selected and arranged in a predetermined order in accordance with the patterns of the branching circuits to be formed, e.g., a single-electrode terminal strip, three-electrode terminal strip, single-electrode terminal strip and a two-electrode terminal strip as shown in FIG. 9, are inserted into corresponding holes 110 along a line transverse to the upper case 101 from the underside of the latter. On the other hand, electric wires 4A of the first group are arranged at the pitch P as shown in FIG. 8, and are forced into the U-shaped slots 14 of the wire grip portions at once by means of, for example, a pressing device, whereby the electric wires 4A are electrically connected to the terminal strips 3.

Figure 10:
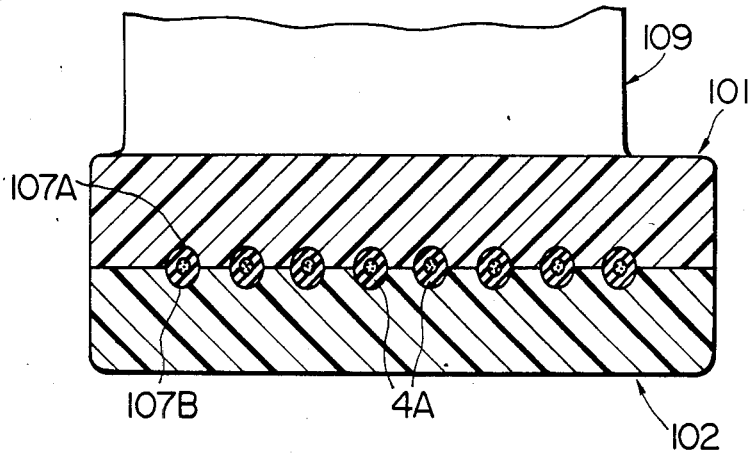

Subsequently, the lower case 102 is attached to the lower side of the upper case 101 and the pillars 115 are welded to the walls of the corresponding holes 116 by, for example, supersonic wave. In consequence, the upper case 101 and the lower case 102 are integrated with each other with the electric wires 4A interposed therebetween, as shown in FIGS. 9 and 10, with the electric wires 4A closely and tightly received in the wire-receiving grooves 107A and 107B of respective cases 101 and 102. The portions of the electric wires on both longitudinal ends of the connector device are bent to be laid in the grooves 107A formed in both longitudinal end surfaces of the upper case 101.

Then, the connectors 5 to which the electric wires 4B of the second group are connected are fitted in the connector receptacles 109 such that female terminals in the connector 5 mate with the male terminals 12 of the terminal strips 3 so that the electric wires 4A and 4B of the first and second groups are electrically connected through the terminal strips 3, thereby forming the required branching circuits in the wire harness 8.

Figure 11:
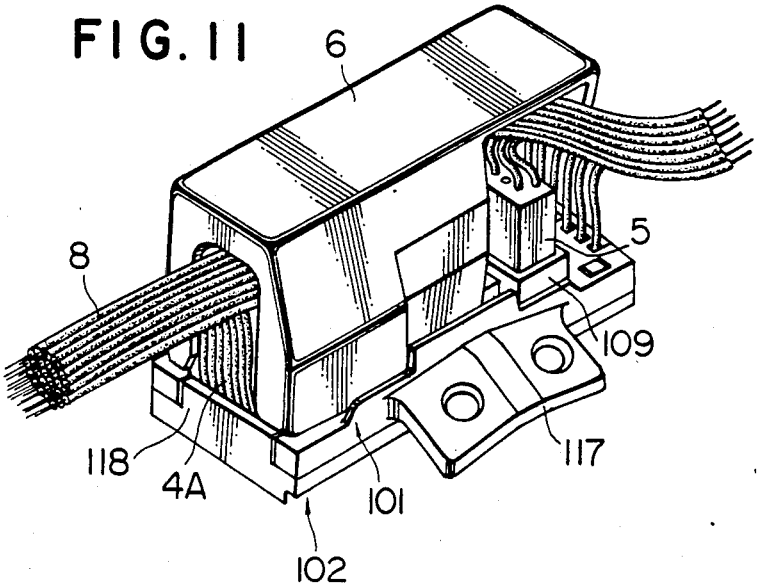
FIG. 11 is a perspective view showing the manner in which the second embodiment of the branching connector device is connected to a wire harness.

Finally, a cover 6 is put on the connector device such as to cover the connector device and the wire bundle constituting the wire harness 8, as shown in FIG. 11. Thus, the branching connector device is held on an intermediate portion of the wire harness 8 and is mounted on a vehicle body by means of a mounting bracket 117 formed as a unit with the upper case 101, so that the wire harness 8 incorporating the branching circuits is fixed to the vehicle body.

Thus, in the second embodiment of the electric wire branching connector device of the invention, the first group of electric wires 4A to be connected are clamped between the upper and lower cases 101 and 102 and are connected to the electric wires 4B of the second group through the terminal strips 3, thus concentrically forming the branching circuits. With this arrangement, it is possible to obtain branching circuits of much smaller and compact construction as compared with the conventional arrangement which makes use of BUS-bar type connector device. At the same time, the number of parts is reduced and the consumption of metal is reduced by virture of the elimination of BUS bars, thereby remarkably reducing the production cost of the connector device.

It is to be noted also that the electric wire branching connector device of the invention can form the desired branching circuits in such a concentrated manner that the device is embraced or held on the wire harness 8 without substantially increasing the outside dimension of the wiring system constituted by the wire harness. Thus, the construction of the wire system as a whole is made quite compact as compared with the conventional arrangement in which the electric wires are extended from the wire harness 8 to a separate joint box which is spaced apart from the wire harness. Thus, the electric wire branching connector device of this embodiment well meets the current demands for a miniaturized and compact wiring system.

The described embodiment of the electric wire branching connector device of the invention is also advantageous in that it permits a greater degree of freedom in the design of the branching circuits, as well as a large adaptability to a variety of design changes.

The second embodiment explained in connection with FIGS. 6 to 11 offers an additional advantage in that, since the electric wires 4A are stably and securely held in the wire-receiving grooves 7A and 7B, any undesirable loosening or disassembly of the electric connection is avoided, thus ensuring a higher stability against vibration and, hence, a higher reliability of the electric connection achieved in the branching connector device.

The electric wires 4A are bent by the guide walls 18 on the lower case 102 at both longitudinal ends of the connector device such that the portions of these wires emerging from both longitudinal ends of the connector device are laid in and along both end walls of the upper case 101. The portions of the electric wires 4A connected to the portions of the same on both end walls of the upper case 101 are laid in parallel with the wire bundle of the wire harness 8. According to this arrangement, any external force applied to the electric wires 4A is borne by the bends of the wires 4A so that any loosening and disassembly of the electric connection in the connector device is avoided such as to ensure higher stability against vibration and higher reliability of the electric connection. This arrangement also contributes to a further reduction in the size of the branching circuit arrangement.

Although the invention has been described through specific terms, it is to be noted that the described embodiment is not exclusive and various changes and modifications may be imparted thereto without departing from the scope of the invention which is limited solely by the appended claims.

What is claimed is:

1. An electric wire branching connector device for forming branching circuits in a wire harness system, comprising:

an upper case and a lower case adapted to clamp therebetween a first group of electric wires extracted from said wire harness system and arranged in a side-by-side fashion; and a plurality of terminal strips inserted into corresponding holes formed in a regular pattern in said upper case, each of said terminal strips being provided at its one end with at least one male terminal adapted to be received in a corresponding one of said holes and at its other end with a wire grip portion having a U-shaped slot, the male terminals of said terminal strips being projected through said holes above the upper surface of said upper case such as to form plugs for receptacle connectors to which are connected electric wires of a second group also extracted from said wire harness system, while said wire grip portions are projected below the underside of said upper case such that the electric wires of said first group are forcibly received in said U-shaped slots, whereby the electric wires of said first group and the electric wires of said second group can be electrically connected to each other through said terminal strips, thereby forming the desired branching circuits, said terminal strips being of at least two types each having a different number of male terminals, and said at least two types of terminal strips being arranged in corresponding ones of said holes in said upper case selectively in accordance with the patterns and the number of the branching circuits.

2. An electric wire branching connector device according to claim 1, wherein said plurality of terminal strips include at least one terminal strip of a first type in which only one male terminal is formed on the same axis as said U-shaped slot and at least one terminal strip of a second type in which at least one additional male terminal is formed on at least one side of a male terminal which is arranged on the same axis as said U-shaped slot, said additional terminal being spaced from adjacent male terminals by a distance which is equal to the pitch of the regular pattern of the holes.

3. An electric wire branching connector device according to claim 1, wherein said upper and lower cases are provided in their opposing surfaces with a plurality of wire-receiving grooves arranged in a side-by-side fashion such that said electric wires of the first group can be received in said wire-receiving grooves in said upper and lower cases.

4. An electric wire branching connector device according to claim 1, further comprising guide walls formed on opposite ends of lower case and adapted to bend, when said upper and lower cases are brought together, projecting portions of the electric wires of the first group such that the bent portions of these electric wires are laid on and along the end surfaces of said upper case.

* * * * *